US006742657B2

(12) United States Patent
Watters et al.

(10) Patent No.: US 6,742,657 B2
(45) Date of Patent: Jun. 1, 2004

(54) INTEGRAL DILUTE MEDIA/PLANT CLEAN-UP SUMP AND PUMP

(75) Inventors: Larry A. Watters, Washington County, PA (US); Daniel S. Placha, Allegheny County, PA (US)

(73) Assignee: Sedgman, LLC, Pittsburgh, PA (US)

( * ) Notice: Subject to any disclaimer, the term of this patent is extended or adjusted under 35 U.S.C. 154(b) by 0 days.

(21) Appl. No.: 10/095,639

(22) Filed: Mar. 12, 2002

(65) Prior Publication Data

US 2003/0173266 A1 Sep. 18, 2003

(51) Int. Cl.[7] ..... B07B 1/00

(52) U.S. Cl. ..... 209/246; 209/3; 209/5; 209/258

(58) Field of Search ..... 209/3, 5, 10, 246, 209/258

(56) References Cited

U.S. PATENT DOCUMENTS

| | | | | | |
|---|---|---|---|---|---|
| 2,932,395 | A | * | 4/1960 | Marot | 209/172.5 |
| 3,791,807 | A | * | 2/1974 | Etzel et al. | 65/451 |
| 3,982,789 | A | * | 9/1976 | Funk | 406/105 |
| 4,028,228 | A | * | 6/1977 | Ferris et al. | 209/39 |
| 4,222,529 | A | * | 9/1980 | Long | 241/77 |
| 4,230,471 | A | * | 10/1980 | Levecque et al. | 65/503 |
| 4,261,196 | A | * | 4/1981 | Scheid, Jr. | 73/32 R |
| 4,416,768 | A | * | 11/1983 | Nosseir | 241/20 |
| 4,866,385 | A | * | 9/1989 | Reichwein | 324/300 |
| 5,314,124 | A | * | 5/1994 | Kindig | 241/20 |
| 5,522,510 | A | * | 6/1996 | Luttrell et al. | 209/170 |
| 6,607,248 | B1 | * | 8/2003 | Childress | 299/10 |

* cited by examiner

*Primary Examiner*—Donald P. Walsh
*Assistant Examiner*—Joseph Rodriguez
(74) *Attorney, Agent, or Firm*—Buchanan Ingersoll PC

(57) ABSTRACT

In a mineral preparation plant which receives a raw mineral feed and separates the raw mineral feed into a clean mineral and a refuse, an apparatus is provided for use therein. The apparatus retains dilute media which is formed as a by-product of the separation process. The apparatus includes a sump formed in a floor of the mineral preparation plant and configured to receive and retain: (a) dilute media, consisting of finely sized particles of mineral, refuse, media and water, from an underpan of at least one refuse screen and a clean mineral screen, and (b) mineral, refuse and media particles spilled by mineral processing equipment in the mineral preparation plant. The apparatus further includes a pump associated with the sump for pumping the dilute media and the spilled mineral, refuse and media particles received in the sump as a mixture to a media separating device, and a nuclear density gauge and integrated control system for controlling the amount of media fed to the media separating device.

8 Claims, 1 Drawing Sheet

INTEGRAL DILUTE MEDIA/PLANT CLEAN-UP SUMP AND PUMP

FIELD OF THE INVENTION

The present invention is directed generally toward coal preparation plants and, more particularly, toward an improved integral dilute media/plant clean-up sump for retaining dilute media and circulating the dilute media for use by the coal preparation plant.

BACKGROUND OF THE INVENTION

Coal preparation plants separate organic and non-organic solid particles by their specific gravities. The coal preparation plant receives a feed of raw mined coal, and separates the raw mined coal into clean coal and refuse. These plants typically utilize two basic processing methods for separating raw coal from rock and varying proportions of striated rock and coal from the higher quality coal. The two processing methods include heavy media and water based separation methods Heavy media, utilizing a slurry of water and media (magnetite or ferrosilicon) to separate the coal from the refuse according to their specific gravity of dry solids, is the most common separation process for larger size (Plus 1 mm–0.5 mm) particles. Whereas, water based separation processes are more commonly used for the "cleaning" of the finer sized particles, as that term is commonly understood in the coal processing art.

The clean coal and refuse from the heavy media type plants are fed to vibratory screens. While on the clean coal and refuse screens, the majority of the recirculating media is recovered in the drain section of the screens. The clean coal and refuse particles are rinsed with water to remove the remaining portion of adhering media. The finer solids particles, media and water passing through the respective screen is defined as dilute media.

The dilute media slurry recovered by the rinse section of the underpans is traditionally piped to a dilute media sump or gravity fed to a magnetic separator. To maintain the required operating specific gravity separation point of the heavy media separation process, a portion, or bleed, of the correct medium slurry recovered by the drain sections is removed from the recirculating medium slurry flow and fed to the dilute media circuit. The dilute media is then pumped from the dilute media sump to a magnetic separator for media recovery. The requirement of having an additional dilute media sump increases the overall size of the plant area, and adds to the cost of building the coal preparation plant.

Additionally, the efficiency of the magnetic separator is directly related to media and/or liquid loading. With gravity fed separators, inconsistent feed volumes can result in poor separator efficiency. When both pump and gravity fed magnetic separators are overloaded with solid media, the excess media is lost to the effluent stream. Such media overloading may occur with increased adjustment in bleed volume to compensate to changes in raw coal characteristics, spillages within the plant when fed with a cleanup sump and after the coal preparation plant has been idled for a period of time allowing the media particles to settle at the bottom of the dilute media sump. Upon plant start-up, a large amount of media may be pumped to the magnetic separator from the dilute media sump, resulting in media being lost due to overloading the magnetic separator.

The present invention is directed toward overcoming one or more of the above-mentioned problems.

SUMMARY OF THE INVENTION

In a coal preparation plant which receives a raw coal feed and separates the raw feed into a clean coal and a refuse, an apparatus is provided for use therein. The inventive apparatus includes a sump formed in a floor of the coal preparation plant and configured to receive and retain: (a) dilute media, consisting of finely sized particles of coal and refuse, media particles and water, from an underpan of at least one of a refuse screen and a clean coal screen, and (b) coal, refuse and media particles spilled by coal processing equipment in the coal preparation plant. The inventive apparatus further includes a pump associated with the sump for pumping the dilute media and the spilled coal, refuse and media particles received in the sump as a mixture to a media separating device.

Typically, the sump will be formed at a lowest most point in the coal preparation plant in order to also function as a clean-up sump. A screen may also be provided over the sump to prevent the larger coal and refuse particles spilled by the coal processing equipment from entering the sump and clogging the pump. Generally, the pump will be installed in the sump, with its pump suction submerged in the dilute media mixture retained in the sump.

Preferably, the media includes magnetite used for separating the coal and refuse particles from the raw coal and, accordingly, the media separating device preferably includes a magnetic separator for recovering the magnetite from the dilute media mixture.

In another form, the inventive apparatus further includes a nuclear density gauge measuring the specific gravity of the mixture being pumped to the media separating device. The nuclear density gauge is wired to a control system and a control valve which is configured to add water to the sump controlling the amount of media pumped to the media separating device to prevent overloading of the media separating device.

Water is provided to the sump by a water source connected to the sump via at least one valve. The nuclear density gauge integrated control system adjusts the at least one valve to add water to the sump and/or pump suction to dilute the mixture based upon the measured specific gravity value of the mixture.

In a further form of the inventive apparatus, the dilute media received in the sump includes the slurry from the rinse section of the underpan of the at least one of the refuse screen and the clean coal screen, and a portion of the correct media collected in a drain section of the underpan of the at least one of the refuse screen and the clean coal screen.

A method of retaining dilute media formed as a by-product of the coal/refuse separation process in a coal preparation plant is also provided. The method generally includes the steps of providing a sump in a floor of the coal preparation plant for receiving coal, refuse and media particles spilled by coal processing equipment in the coal preparation plant and dilute media from an underpan of at least one of a refuse screen and a clean coal screen. The dilute media and the spilled coal, refuse and media particles received in the sump as a mixture will be pumped to a media separating device. Preferably, the media includes magnetite, and the media separating device includes a magnetic separator.

In one form, the method further includes the step of controlling the amount of media in the mixture provided to the media separating device. The controlling step may include measuring the specific gravity of the mixture provided to the media separating device, and adding water to the sump to dilute the mixture in response to the measured specific gravity value.

In another form of the inventive method, the mixture in the sump is pumped to the media separating device, via a pump, with the water added to the sump to dilute the mixture being added near the pump suction within the sump.

In a further form of the inventive method, a select portion of the dilute media received in the underpan of the at least one of the refuse screen and the clean coal screen is directed to the sump. This select portion of the dilute media typically includes the dilute media collected in a rinse section of the underpan of the at least one of the refuse screen and the clean coal screen, and a portion of the correct media collected in a drain section of the underpan of the at least one of the refuse screen and the clean coal screen.

Preferably, in order for the sump to also function as a clean-up sump, it is provided at a lowest most point in the coal preparation plant. A screen will typically be provided over the sump to prevent the larger coal and refuse particles spilled by the coal processing equipment from entering the sump and clogging the pump.

It is an object of the present invention to:

remove the need for a dilute media sump in coal preparation plants; and control the amount of media provided to a media separating device within a coal preparation plant.

Other objects, aspects and advantages of the present invention can be obtained from a study of the specification, the drawings, and the appended claims.

DETAILED DESCRIPTION OF THE INVENTION

Figure 1:
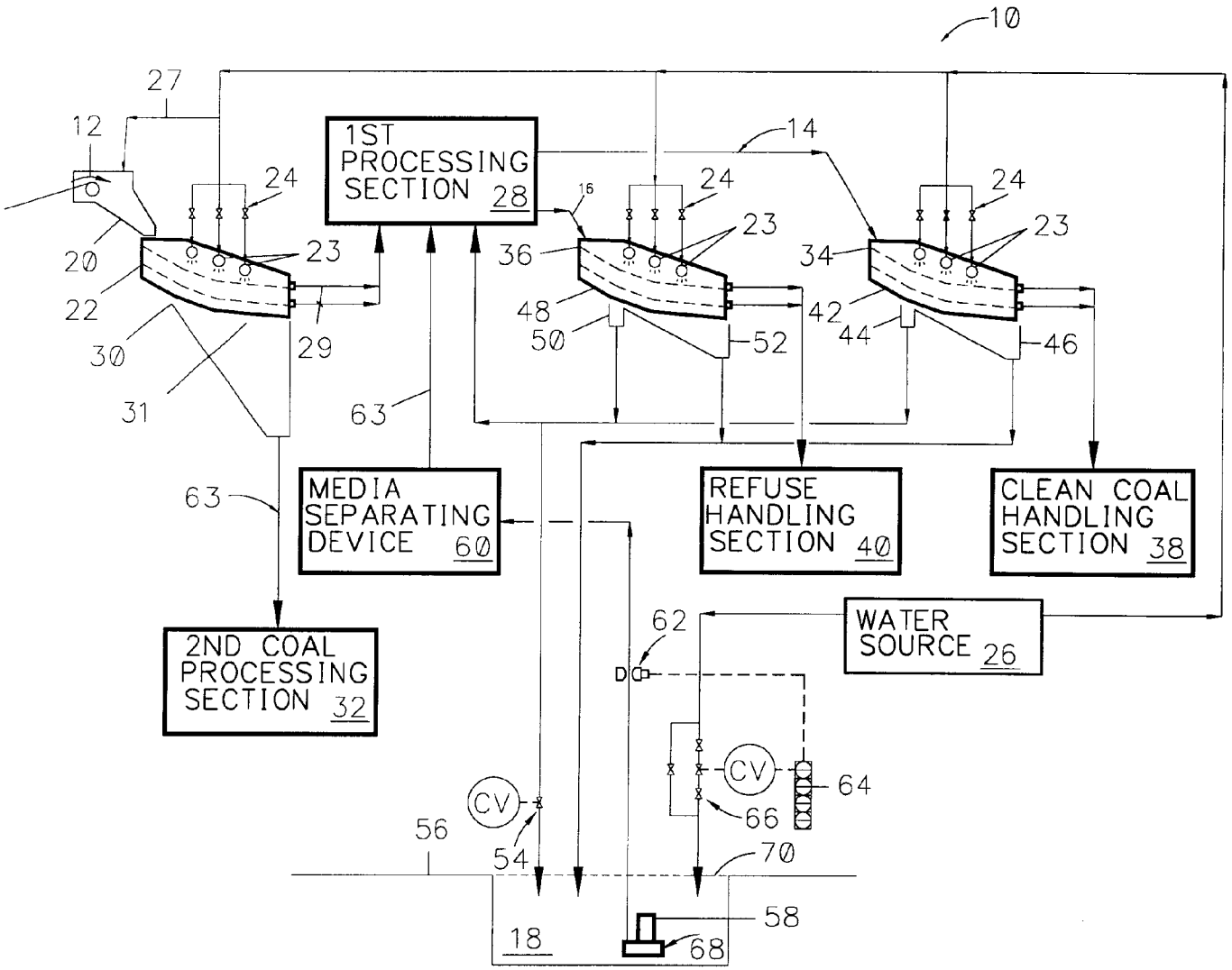
FIG. 1 is a block diagram of a coal preparation plant incorporating the inventive, dual-function sump according to the present invention.

Referring to FIG. 1, a coal preparation plant is shown generally at 10. The coal preparation plant 10 typically receives a raw coal feed 12 and separates the raw coal feed 12 into clean coal 14 and refuse 16. Typically, a by-product of dilute media, consisting of finely sized particles of coal, refuse, media, e.g., magnetite, and water is formed as a result of the coal separation process. The coal preparation plant 10 incorporates a dual purpose dilute media/plant clean-up sump 18 according to the present invention. As will be described hereafter, the dilute media/plant clean-up sump 18 is provided both for the retention of the dilute media and the clean-up of the coal preparation plant 10, thus eliminating the need for separate sumps and aiding in minimizing the overall plant area.

The raw coal feed 12 received by the coal preparation plant 10 is fed to a feedbox 20 of a deslime screen 22. The feedbox 20 directs the raw coal feed 12 to the deslime screen 22 where the raw coal feed 12 is sorted according to size to separate the coarse and fine raw coal particles. The deslime screen 22 may include sprayers 23 connected by valves 24 to a water source 26 for applying water to the raw coal particles 12 as they move along the length of the deslime screen 22. Additionally, water may be applied to and mixed with the raw coal feed 12 in the feedbox 20 via line 27. The coarse raw coal feed particles 29 screened by the deslime screen 22 are fed to a first coal processing section 28 of the coal preparation plant 10. The first coal processing section 28 utilizes conventional coal processing techniques to produce the clean coal 14 and the refuse 16. Typically, these techniques will include heavy media separation methods utilizing a media, such as magnetite, to separate the clean coal particles 14 from the refuse particles 16 according to their specific gravities. The finer raw coal feed particles 31 passed to an underpan 30 of the deslime screen 22 are fed to a second coal processing section 32, which conventionally processes those finer coal particles 31, typically utilizing water based separation methods.

The clean coal particles 14 are fed to a clean coal screen 34 where screen vibration and rinse water are used to remove media and misplaced fines therefrom. Similarly, the refuse particles 16 are fed to a refuse screen 36 where screen vibration and rinse water are also used to remove media and misplaced fines therefrom. The clean coal particles 14 retained on the clean coal screen 34 are fed to a conventional clean coal handling section 38 of the coal preparation plant 10, while the refuse particles 16 retained on the refuse screen 36 are fed to a conventional refuse handling section 40 of the coal preparation plant 10.

Since magnetite is typically utilized as the media in the coarse coal processing section 28 for separating the clean coal 14 from the refuse 16, the clean coal and refuse particles passing over the clean coal 34 and refuse 36 screens, respectively, both will include particles of magnetite thereon. Since magnetite is generally expensive, feeding the particles across the clean coal 34 and refuse 36 screens is done primarily to recover the magnetite particles adhering thereon for recirculation through the coal preparation plant 10.

The clean coal screen 34 includes an underpan 42 divided into a drain section 44 and rinse section 46. The majority of the magnetite will be removed from the clean coal particles 14 in the drain section 44 via vibration of the clean coal screen 34. To recover residual magnetite that has not passed through the clean coal screen 34 to the drain section 44, water is used to rinse the solid coal particles of magnetite adhering thereon, and any solid clean coal particles that have broken to be finer than the clean coal screen 34 aperture openings (misplaced fines). The water is provided by the sprayers 23 connected to the water source 26, and is only provided at the rinse section 46 of the underpan 42. The residual magnetite, water and misplaced fines will thus be received in the rinse section 46 of the underpan 42.

Similarly, the refuse screen 36 includes an underpan 48 which is divided into a drain section 50 and a rinse section 52. The majority of the magnetite will be removed from the refuse particles 16 in the drain section 50 via vibration of the refuse screen 36. To recover residual magnetite that has not passed through the refuse screen 36 to the drain section 50, water is used to rinse the solid refuse particles of magnetite adhering thereon, and any solid refuse particles that have broken to be finer than the refuse screen 36 aperture openings (misplaced fines). The water is provided by the sprayers 23 connected to the water source 26, and is only provided at the rinse section 52 of the underpan 48. The residual magnetite, water and misplaced fines will thus be received in the rinse section 52 of the underpan 48.

Typically, the slurry of media, water and particles received in the drain sections 44 and 50 is known as a correct medium slurry. The slurry of media, water and particles received in the rinse sections 46 and 52 is typically known as a dilute media slurry. The correct medium slurries received in the drain sections 44 and 50 are combined and fed to the first coal processing section 28 for recirculation through the coal preparation plant 10. A control valve 54 or similar system thereof is included in the correct medium slurry flow which bleeds off a portion of the correct medium slurry and feeds it to the dilute media/plant clean-up sump 18. The dilute media slurries from the rinse sections 46 and 52 are combined and fed to the dilute media/plant clean-up sump 18.

The sump 18 is formed in the floor 56 of the coal preparation plant 10, and is typically formed at a lowest most point of the coal preparation plant 10. The sump 18 is utilized as the clean-up sump for the coal preparation plant 10, where coal, refuse and media particles spilled by coal processing equipment within the coal preparation 10 may be directed. It is particularly important that any magnetite spilled by the coal processing equipment be collected in the clean-up sump 18 for recirculation, as magnetite is quite expensive. A typical method of cleaning the coal preparation plant 10 is to wash the plant 10 with streams of water from hoses such that any spilled coal, refuse or media particles are directed to the sump 18 by the flow of the water due to gravity. In this regard, locating the sump 18 at the lowest most point of the coal preparation plant 10 has a distinct advantage.

A pump 58 is provided within the sump 18 for pumping the dilute media and spilled particles received in the sump 18 as a mixture to a media separating device 60, such as a magnetic separator. The media separating device 60 retrieves the media from the mixture and directs the retrieved media to the first coal processing section 28, at line 63, for recirculation through the coal preparation plant 10.

The efficiency of the media separating device 60 is directly related to media and/or volumetric loading. For example, when magnetic separators are overloaded, excess magnetite is lost to the effluent stream. This is undesirable, since magnetite is generally expensive. Such overloading will typically occur with increases in bleed, spillages, and after the coal preparation plant 10 has been shut down for a period of time allowing the magnetite within the mixture to rest at the bottom of the sump 18. Upon plant start-up, a large amount of magnetite is pumped to the media separating device 60, causing overloading and loss of magnetite.

To help overcome this problem, a nuclear density gauge 62 is provided which measures the specific gravity of the mixture pumped to the media separating device 60. The nuclear density gauge 62 controls the total tonnage, or amount, of media which flows to the media separating device 60 by the addition of water to the sump 18. The nuclear density gauge 62, via control circuitry 64, controls valves 66 which are connected to the water source 26 to add water to the sump 18 in accordance with the measured specific gravity value. For example, if the specific gravity value measured by the nuclear density gauge 62 is too high, the valves 66 will open to allow the addition of water from the water source 26 to the sump 18 to dilute the mixture and lower its specific gravity, and therefore the amount of media flowing to the media separating device 60. For controlling blockages at the pump suction, the water is added to the sump 18 at or near the suction 68 of the pump 58 within the sump 18.

In order to ensure that large particles of coal and refuse are not received in the sump 18, thus clogging the pump 58, a screen 70 is provided over the sump 18.

The present invention has the advantage of alleviating the requirement of a separate dilute media sump for retaining the dilute media from the underpans 42 and 48 of the clean coal 34 and refuse 36 screens, respectively. The sump 18 is used for both dilute media retention and clean-up purposes, and by using only one sump the overall plant area is reduced.

While the present invention has been described with particular reference to the drawings, it should be understood that various modifications could be made without departing from the spirit and scope of the present invention. For instance, while separate clean coal 34 and refuse 36 screens are illustrated, one partitioned screen may be utilized in place thereof. Thus, only one underpan would be necessary, with the underpan partitioned into combined drain and rinse sections. Still further, while the inventive dilute media/plant clean-up sump 18 has been shown and described herein as used in a coal preparation plant 10, the inventive dilute media/plant clean-up sump 18 may be utilized in preparation plants for ore and minerals other than coal, using separation media other than magnetite, without departing from the spirit and scope of the present invention.

We claim:

1. In a mineral preparation plant receiving a raw mineral feed and separating the raw mineral feed into a clean mineral and a refuse, an apparatus for retaining dilute media formed as a by-product of the separation process, said apparatus comprising:

a sump formed in a floor of the mineral preparation plant, the sump configured to receive and retain (a) dilute media from an underpan of at least one of a refuse screen and a clean mineral screen, and (b) mineral, refuse and media particles spilled by mineral processing equipment in the mineral preparation plant, wherein the dilute media comprises finely sized particles of mineral, refuse, media and water;

a pump feeding the dilute media and the spilled mineral, refuse and media particles received in the sump as a mixture to a media separating device;

a nuclear density gauge and integrated control system for measuring a specific gravity of the mixture from the pump and adding water to the sump to control slurry density and subsequently the amount of media pumped to the media separating device; and a water source providing water to the sump via at least one valve, wherein the nuclear density gauge and integrated control system controls at least one valve to add water to the sump based upon the measured specific gravity valve, wherein the water is provided to the sump by the water source at a pump suction head within the sump.

2. The apparatus of claim 1, wherein the pump is disposed in the sump.

3. The apparatus of claim 1, wherein the sump is formed at a lowest most point in the mineral preparation plant.

4. The apparatus of claim 1, wherein the dilute media from the underpan of at least one of the refuse screen and clean mineral screen comprises:

one-hundred percent of the dilute media collected in a rinse section of the underpan of at least one of the refuse screen and the clean mineral screen; and a portion of a correct medium slurry collected in a drain section of the underpan of at least one of the refuse screen and the clean mineral screen.

5. The apparatus of claim 1, wherein the mineral comprises coal, the media comprises magnetite, and the media separating device comprises a magnetic separator.

6. In a mineral preparation plant receiving a raw mineral feed and separating the raw mineral feed into a clean mineral and a refuse using a media separation process, a method for retaining dilute media formed as a by-product of the media separation process, said method comprising the steps of:

providing a sump in a floor of the mineral preparation plant for receiving mineral, refuse and media particles spilled by mineral processing equipment in the mineral preparation plant;

directing dilute media from an underpan of at least one of a refuse screen and a clean mineral screen to the sump, wherein the dilute media comprises finely sized particles of mineral and refuse, particles of media and water;

providing a pump in the sump for feeding the dilute media and the spilled mineral, refuse and media particles received in the sump as a mixture to a media separating device;

measuring a specific gravity of the mixture pumped to the media separating device; and adding water to the mixture to control the amount of media in the mixture pumped to the media separating device in a response to the measured specific gravity value, wherein the step of adding water to the mixture comprises the step of adding water to the sump at or near the pump suction within the sump.

7. The method of claim 5, further comprising the step of providing a screen over the sump preventing the larger mineral and refuse particles spilled by the mineral processing equipment from entering the sump.

8. The method of claim 5, wherein the mineral comprises coal, wherein the media comprises magnetite, and wherein the media separating device comprises a magnetic separator.

* * * * *